US012059037B2

(12) United States Patent
Qian et al.

(10) Patent No.: US 12,059,037 B2
(45) Date of Patent: Aug. 13, 2024

(54) LEAKAGE-PROOF ELECTRONIC ATOMIZER

(71) Applicants: Ningbo Yilan Yasi Skin Care Products Co., Ltd., Zhejiang (CN); Shanghai Enxi Biological Technology Co., Ltd., Shanghai (CN)

(72) Inventors: Xuli Qian, Zhejiang (CN); Qijun Ye, Zhejiang (CN)

(73) Assignees: Ningbo Yilan Yasi Skin Care Products Co., Ltd., Zhejiang (CN); Shanghai Enxi Biological Technology Co., Ltd., Shanghai (CN)

( * ) Notice: Subject to any disclaimer, the term of this patent is extended or adjusted under 35 U.S.C. 154(b) by 274 days.

(21) Appl. No.: 17/685,361

(22) Filed: Mar. 2, 2022

(65) Prior Publication Data

US 2023/0180841 A1 Jun. 15, 2023

(30) Foreign Application Priority Data

Dec. 14, 2021 (CN) ..... 202111530330.8

(51) Int. Cl.

| | |
|---|---|
| ***A24F 40/485*** | (2020.01) |
| ***A24D 3/17*** | (2020.01) |
| ***A24F 40/10*** | (2020.01) |
| ***A24F 40/42*** | (2020.01) |
| ***A24F 40/50*** | (2020.01) |
| ***A24F 40/60*** | (2020.01) |

(52) U.S. Cl.

CPC ..... *A24F 40/485* (2020.01); *A24D 3/17* (2020.01); *A24F 40/10* (2020.01); *A24F 40/42* (2020.01); *A24F 40/50* (2020.01); *A24F 40/60* (2020.01)

(58) Field of Classification Search

CPC ..... A24F 40/42; A24F 40/485; A24F 40/10; A24F 40/50; A24F 40/60; A24D 3/17

USPC ..... 131/271, 328, 329

See application file for complete search history.

(56) References Cited

U.S. PATENT DOCUMENTS

| | | | | |
|---|---|---|---|---|
| 10,070,669 | B2 * | 9/2018 | Monsees | A24B 15/167 |
| 10,130,123 | B2 * | 11/2018 | Hatton | H05B 1/0244 |
| 10,292,429 | B2 * | 5/2019 | Duc | A61M 15/06 |
| 2014/0069424 | A1 * | 3/2014 | Poston | A61M 15/06 128/202.21 |
| 2015/0208730 | A1 * | 7/2015 | Li | A24F 40/485 131/329 |
| 2016/0157522 | A1 * | 6/2016 | Zhu | A24F 40/46 392/404 |
| 2016/0157524 | A1 * | 6/2016 | Bowen | H05B 1/0244 702/50 |

(Continued)

*Primary Examiner* — Michael H. Wilson
*Assistant Examiner* — Ardith Elyse Hertzog
(74) *Attorney, Agent, or Firm* — JCIPRNET

(57) ABSTRACT

A leakage-proof electronic atomizer includes a shell, a cartridge, a second orifice plate, and a pushing component. The shell is provided with a gas channel. The gas channel includes a gas inlet at one end and a gas outlet at the other end, and the top of the shell is provided with an accommodation cavity with an upper-end opening. The cartridge is detachably arranged in the accommodation cavity, and the pushing component is configured to drive a first orifice plate to slide so that first square holes of the first orifice plate are in communication with second square holes of the second orifice plate, allowing atomized e-liquid in the cartridge to enter into the gas channel.

8 Claims, 9 Drawing Sheets

(56) References Cited

U.S. PATENT DOCUMENTS

| | | | | |
|---|---|---|---|---|
| 2017/0231276 | A1* | 8/2017 | Mirinov | H05B 1/0244<br>131/328 |
| 2017/0266397 | A1* | 9/2017 | Mayle | A61M 15/06 |
| 2018/0020733 | A1* | 1/2018 | Jochnowitz | F22B 1/284<br>131/329 |
| 2022/0202097 | A1* | 6/2022 | Illidge | A24F 40/10 |
| 2023/0189884 | A1* | 6/2023 | Zominy | A24F 40/42<br>131/329 |

* cited by examiner

C–C

C–C

LEAKAGE-PROOF ELECTRONIC ATOMIZER

CROSS-REFERENCE TO RELATED APPLICATION

This application claims the priority benefit of China application serial no. 202111530330.8, filed on Dec. 14, 2021. The entirety of the above-mentioned patent application is hereby incorporated by reference herein and made a part of this specification.

BACKGROUND

Technical Field

The present invention relates to the field of atomizers, and in particular, to a leakage-proof electronic atomizer.

Description of Related Art

Electronic atomizers are also referred to as electronic cigarettes, which heat up e-liquid to atomize it, thus achieving an effect similar to smoking. With the improvement of living standards, cigarettes that burn shredded tobacco have gradually become synonyms of health hazards, so that many people choose to quit cigarettes, and electronic cigarettes are gradually accepted by smokers because of lower cost and lower harmful substances, and become a substitute for cigarettes.

However, the e-liquid, after atomization, needs to enter the trachea to enter the human body, so that the e-liquid in a cartridge is always in communication with the outside. As a result, the e-liquid in the electronic cigarette has the problem of continuous volatilization, which leads to a short storage time and a large natural loss.

SUMMARY

Based on the above, it is necessary to provide a leakage-proof electronic atomizer to solve the above problems.

A leakage-proof electronic atomizer is disclosed in the present invention. The leakage-proof electronic atomizer includes a shell, a cartridge, a second orifice plate, and a pushing component. The shell is provided with a gas channel. The gas channel includes a gas inlet at one end and a gas outlet at the other end, and a top of the shell is provided with an accommodation cavity with an upper-end opening. The cartridge is detachably arranged in the accommodation cavity and includes a cartridge body, an electric heating wire, a first orifice plate, and a first elastic member. The electric heating wire is arranged in the cartridge body and is configured to heat e-liquid in the cartridge body to generate smoke, the first orifice plate is slidably arranged on the cartridge body, one end of the first elastic member abuts against the shell, and the other end of the first elastic member abuts against the first orifice plate. The second orifice plate is slidably arranged in the shell. The first orifice plate is attached to the second orifice plate, and by moving the first orifice plate and the second orifice plate, a through hole on the first orifice plate is allowed to be in communication with a through hole on the second orifice plate, so that the smoke generated by the cartridge is able to enter the gas channel. The pushing component includes a sliding push block, a hinge block, and an opening member. The opening member is rotatably arranged on the shell and is located on an upper side of the gas outlet, the hinge block is hinged on the shell and abuts against the opening member, the sliding push block is slidably arranged in the shell, and has one end abutting against one end of the first orifice plate away from the first elastic member and the other end abutting against the hinge block, and when the opening member rotates in a forward direction, the hinge block is configured to be driven to rotate in the forward direction, thereby pushing the sliding push block to slide in a direction toward the gas inlet and further pushing the first orifice plate to slide.

In one embodiment, the opening member is rotatably provided with an abutting member, and the hinge block is provided with a plurality of clamping slots, and by rotating the abutting member, the abutting member is allowed to abut against different clamping slots, thus forming different angles between the opening member and the hinge block.

In one embodiment, the shell is provided with a tension spring, and the tension spring is connected to the opening member so that the opening member abuts against the hinge block.

In one embodiment, the second orifice plate is slidably arranged in the shell, a second elastic member is arranged between the second orifice plate and the shell, a magnetic member is arranged on one end of the second orifice plate away from the second elastic member, and the shell is further provided with a power supply, an electromagnet, a microphone, and a control unit. The power supply, the electromagnet, the microphone, the control unit, and the electric heating wire are electrically connected. According to the magnitude of a wind sound received by the microphone, the control unit is configured to control the magnitude of a current in a circuit, and after the microphone detects the sound, the electromagnet generates a magnetic field to repel the magnetic member, thereby pushing the second orifice plate to slide away from the electromagnet to press the second elastic member.

In one embodiment, the first orifice plate is provided with a plurality of first square holes, the second orifice plate is provided with a plurality of second square holes corresponding to the plurality of first square holes on the first orifice plate, when the first orifice plate moves in a direction towards the gas inlet, the plurality of second square holes are in communication with the plurality of first square holes, respectively, and as the first orifice plate gets closer to the gas inlet, an overlapping area of the second square holes and the first square holes is increased.

In one embodiment, when the hinge block is rotated without being abutted by the opening member, one end of the hinge block adjacent to the first orifice plate is located on a moving path of the second orifice plate so as to limit the sliding of the second orifice plate, and after the hinge block is rotated in the forward direction, the hinge block is allowed to leave the moving path of the second orifice plate, thereby enabling the second orifice plate to slide freely.

In one embodiment, the gas channel is provided with a filter plate.

In one embodiment, the shell is provided with sinking grooves on two sides of the cartridge, and a top surface of the cartridge is higher than the bottoms of the sinking grooves.

In one embodiment, baffles are respectively provided on two sides of the opening member, the shell is provided with escape grooves corresponding to the baffles, and the baffles extend into the escape grooves.

In one embodiment, a first magnetic attraction member is provided on a lower side of the cartridge body, and the accommodation cavity is provided with a second magnetic attraction member. When the cartridge body is arranged in the accommodation cavity, the first magnetic attraction member and the second magnetic attraction member are attracted to each other.

Advantages of the present invention include the following.

(1) By arranging the first orifice plate and the second orifice plate, e-liquid can be sealed and stored when not in use, thereby avoiding natural volatilization of the e-liquid and prolonging the utilization efficiency of the e-liquid.

(2) By arranging the pushing component, the position of the first orifice plate is controlled by the bite of a smoker's mouth, and therefore, the first orifice plate needs to be moved before sucking so that the e-liquid can smoothly enter the gas channel.

(3) By arranging the first square holes and the second square holes, the positions of the first orifice plate and the second orifice plate are controlled, so that the size of the overlapping area of the first square holes and the second square holes can be controlled, thereby controlling the magnitude of the smoke output.

(4) By arranging the plurality of clamping slots, the angle between the opening member and the hinge block can be adjusted to control the position of the first orifice plate after the opening member is engaged with the shell, so that the suction power used by the smoker to obtain the maximum amount of smoke can be adjusted, thus being adapted to needs of different smokers for smoking manners.

DESCRIPTION OF THE EMBODIMENTS

The technical solutions in the embodiments of the present invention will be clearly and completely described below with reference to the accompanying drawings in the embodiments of the present invention. Obviously, the described embodiments are only a part of the embodiments of the present invention, rather than all the embodiments. Based on the embodiments of the present invention, all other embodiments obtained by those of ordinary skill in the art without creative efforts shall fall within the protection scope of the present invention.

It should be noted that when a component is referred to as being "installed on" another component, it may be directly located on another component or there may be an intermediate component. When a component is considered to be "arranged on" another component, it may be directly arranged on another component or there may be an intermediate component at the same time. When a component is considered to be "fixed to" another component, it may be directly fixed to another component or there may be an intermediate component at the same time.

Unless otherwise defined, all technical and scientific terms used herein have the same meaning as commonly understood by those skilled in art of the present invention. The terms used in the specification of the present invention herein are only for the purpose of describing specific embodiments, and are not intended to limit the present invention. The term "or/and" as used herein includes any and all combinations of one or more related listed items.

Figure 1:
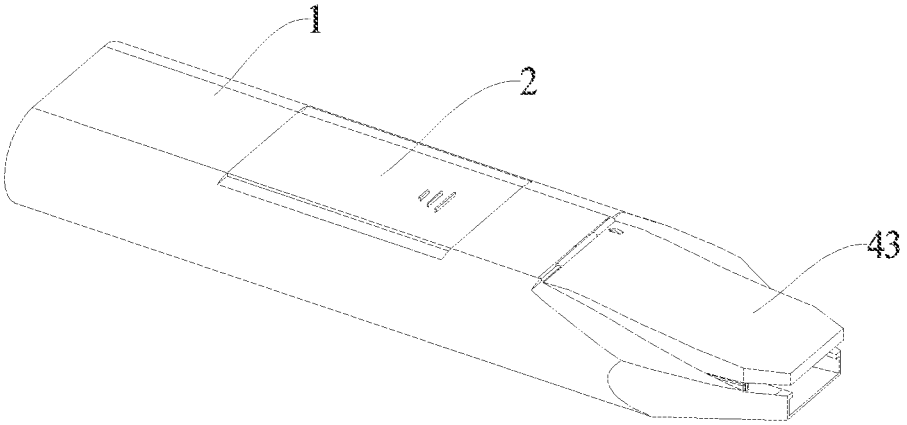
FIG. 1 is a perspective view of a leakage-proof electronic atomizer according to the present invention.
Figure 2:
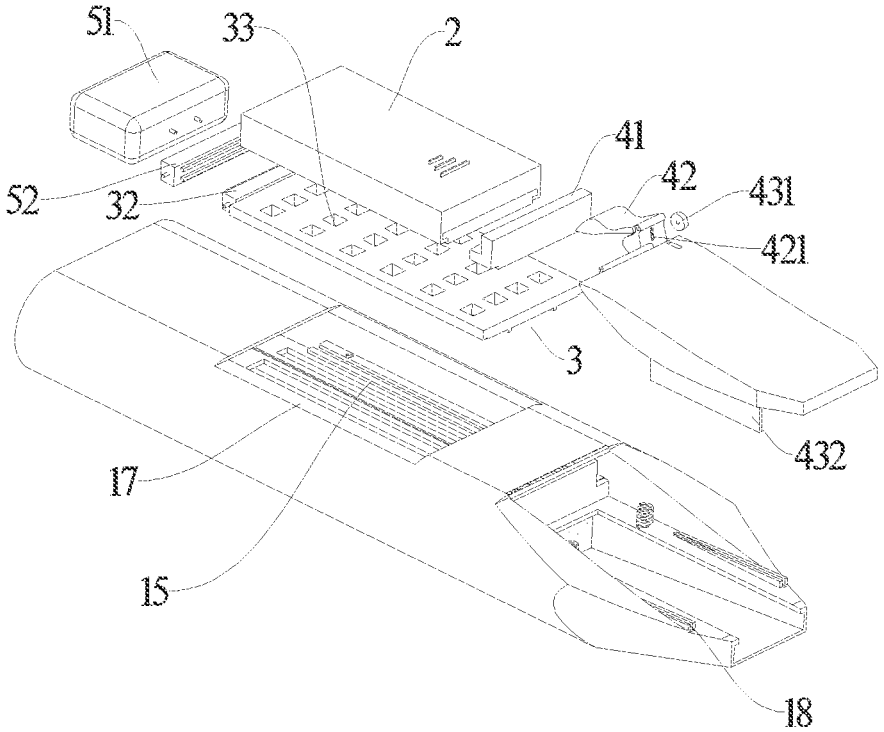
FIG. 2 is an exploded view of a leakage-proof electronic atomizer according to the present invention.
Figure 3:
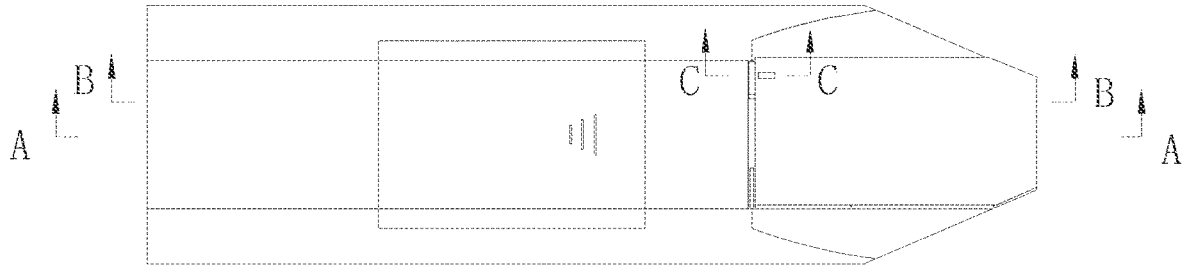
FIG. 3 is a top view of a leakage-proof electronic atomizer according to the present invention.
Figure 4:
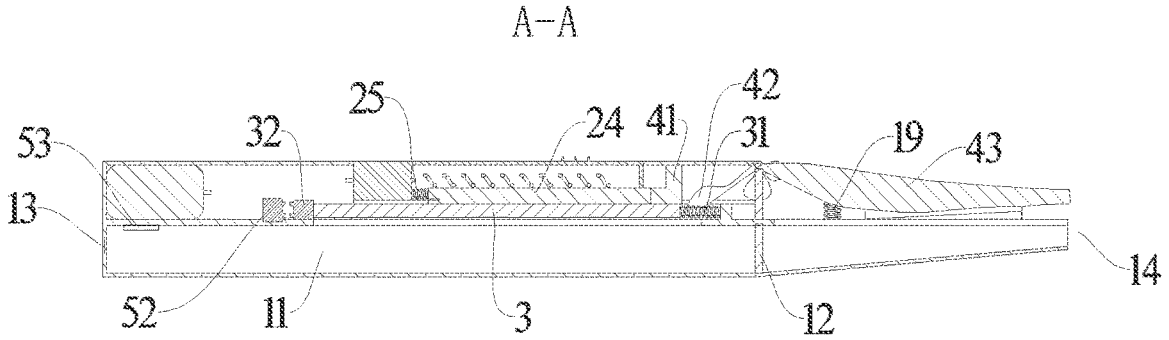
FIG. 4 is a cross-sectional view based on an A-A plane of FIG. 3 according to the present invention.
Figure 12:
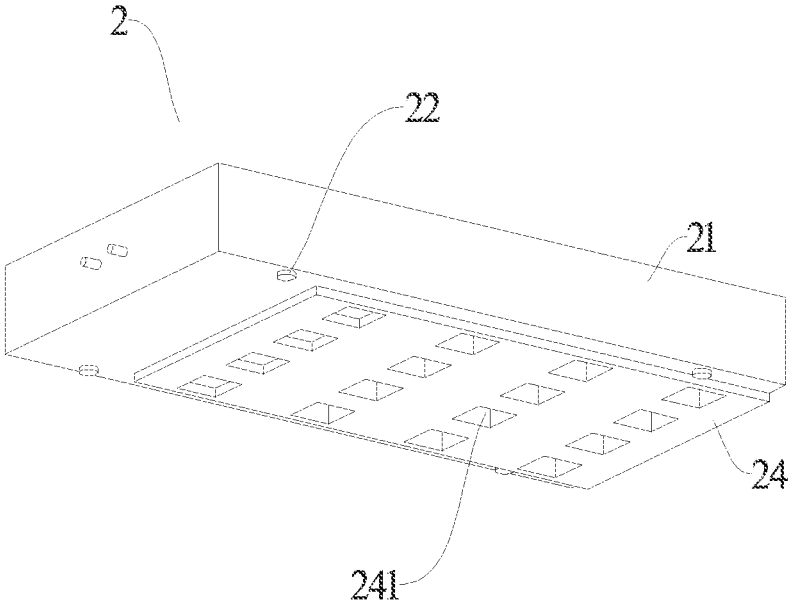
FIG. 12 is a perspective view of a cartridge of a leakage-proof electronic atomizer according to the present invention.
Figure 13:
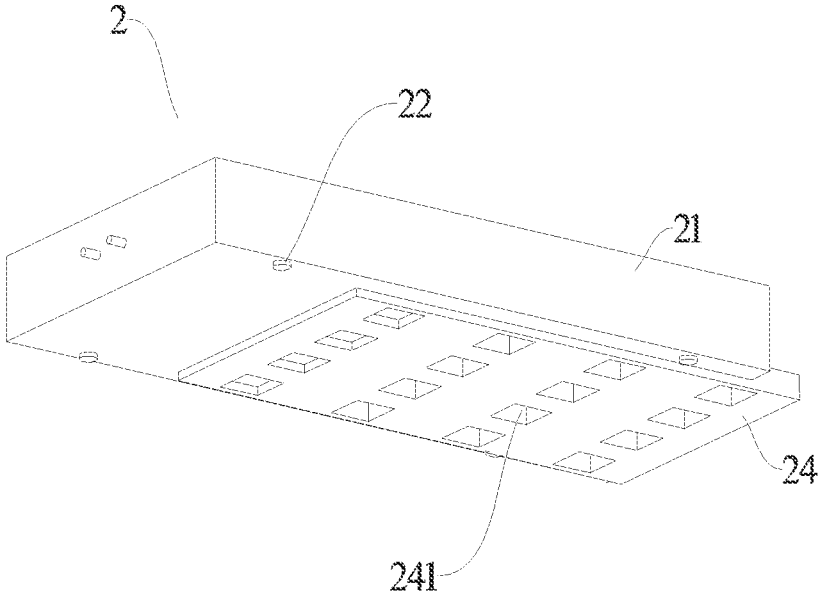
FIG. 13 is a perspective view of a cartridge of a leakage-proof electronic atomizer according to the present invention in another working state.

As shown in FIG. 1 to FIG. 4 and FIG. 11, a leakage-proof electronic atomizer is disclosed in the present invention. The leakage-proof electronic atomizer includes a shell 1, a cartridge 2, a second orifice plate 3, and a pushing component. The shell 1 is provided with a gas channel 11, the gas channel 11 includes a gas inlet 13 at one end and a gas outlet 14 at the other end, and the top of the shell 1 is provided with an accommodation cavity 15 with an upper-end opening. The cartridge 2 is detachably arranged in the accommodation cavity 15. Accompanying with FIG. 12 and FIG. 13, the cartridge 2 includes a cartridge body 21, an electric heating wire, a first orifice plate 24, and a first elastic member 25 as shown in FIG. 4. The electric heating wire is arranged in the cartridge body 21 and is configured to heat e-liquid in the cartridge body 21 to generate smoke. The first orifice plate 24 is slidably arranged on the cartridge body 21, one end of the first elastic member 25 abuts against the shell 1, and the other end of the first elastic member 25 abuts against the first orifice plate 24. The second orifice plate 3 is slidably arranged in the shell 1. The first orifice plate 24 is attached to the second orifice plate 3, and by moving the first orifice plate 24 and the second orifice plate 3, a through hole on the first orifice plate 24 is allowed to be in communication with a through hole on the second orifice plate 3, so that the smoke generated by the cartridge 2 is able to enter the gas channel 11. The pushing component includes a sliding push block 41, a hinge block 42, and an opening member 43. The opening member 43 is rotatably arranged on the shell 1 and is located on an upper side of the gas outlet 14. The hinge block 42 is hinged on the shell 1 and abuts against the opening member 43. The sliding push block 41 is slidably arranged in the shell 1, and has one end abutting against one end of the first orifice plate 24 away from the first elastic member 25 and the other end abutting against the hinge block 42. When the opening member 43 rotates in a forward direction, the hinge block 42 is configured to be driven to rotate in the forward direction, thereby pushing the sliding push block 41 to slide in a direction toward the gas inlet 13 and further pushing the first orifice plate 24 to slide.

Preferably, the opening member 43 is rotatably provided with an abutting member 431, and the hinge block 42 is provided with a plurality of clamping slots 421. By rotating the abutting member 431, the abutting member 431 is allowed to abut against different clamping slots 421, thus forming different angles between the opening member 43 and the hinge block 42.

Preferably, the shell 1 is provided with a tension spring 19, and the tension spring 19 is connected to the opening member 43 so that the opening member 43 abuts against the hinge block 42. It should be noted that, by arranging the tension spring 19, the opening member 43 is allowed to always abut against the hinge block 42. It should be noted that the elastic force of the tension spring 19 is relatively weak. Under the action of the first elastic member, the opening member 43 can automatically reset to an open state.

Preferably, the second orifice plate 3 is slidably arranged in the shell 1, a second elastic member 31 is arranged between the second orifice plate 3 and the shell 1, and a magnetic member 32 is arranged on one end of the second orifice plate 3 away from the second elastic member 31. The shell 1 is further provided with a power supply 51, an electromagnet 52, a microphone 53, and a control unit. The power supply 51, the electromagnet 52, the microphone 53, the control unit, and the electric heating wire are electrically connected. According to the magnitude of a wind sound received by the microphone 53, the control unit is configured to control the magnitude of a current in a circuit. After the microphone 53 detects the sound, the electromagnet 52 generates a magnetic field to repel the magnetic member 32, thereby pushing the second orifice plate 3 to slide away from the electromagnet 52 to press the second elastic member 31.

It can be understood that when the cartridge 2 is arranged in the accommodation cavity 15, the cartridge 2 is electrically connected to the power supply.

Preferably, the first orifice plate 24 is provided with a plurality of first square holes 241, the second orifice plate 3 is provided with a plurality of second square holes 33 corresponding to the first square holes 241 on the first orifice plate 24. When the first orifice plate 24 moves in a direction towards the gas inlet 13, the second square holes 33 are in communication with the first square holes 241, respectively, and as the first orifice plate 24 gets closer to the gas inlet 13, an overlapping area of the second square holes 33 and the first square holes 241 is increased.

Figure 9:
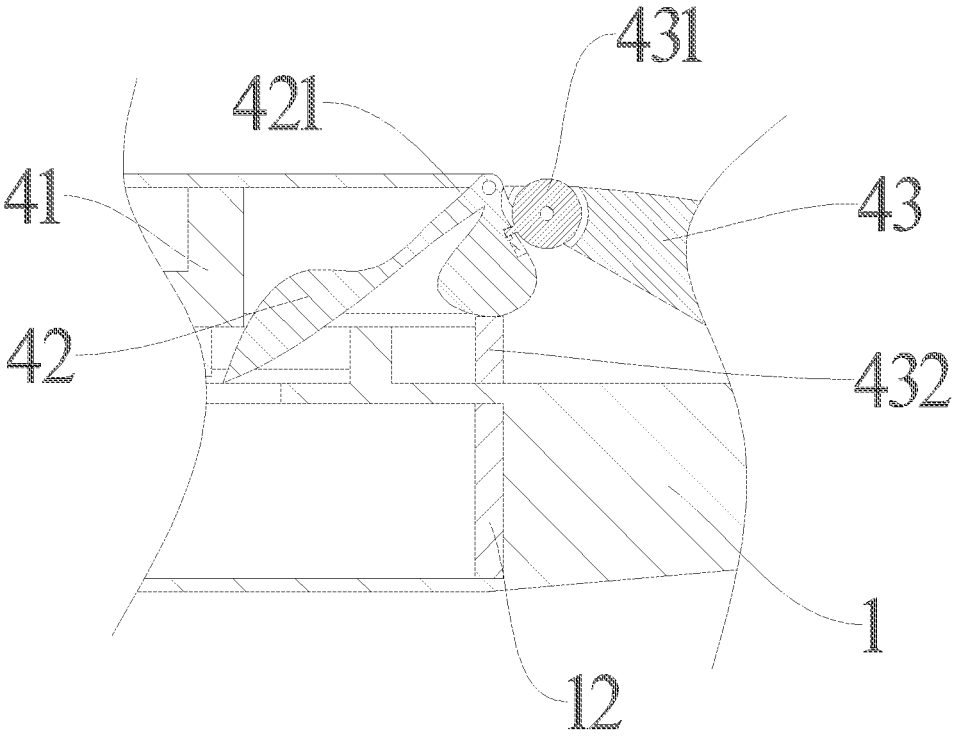
FIG. 9 is a cross-sectional view based on a C-C plane of FIG. 3 according to the present invention.
Figure 10:
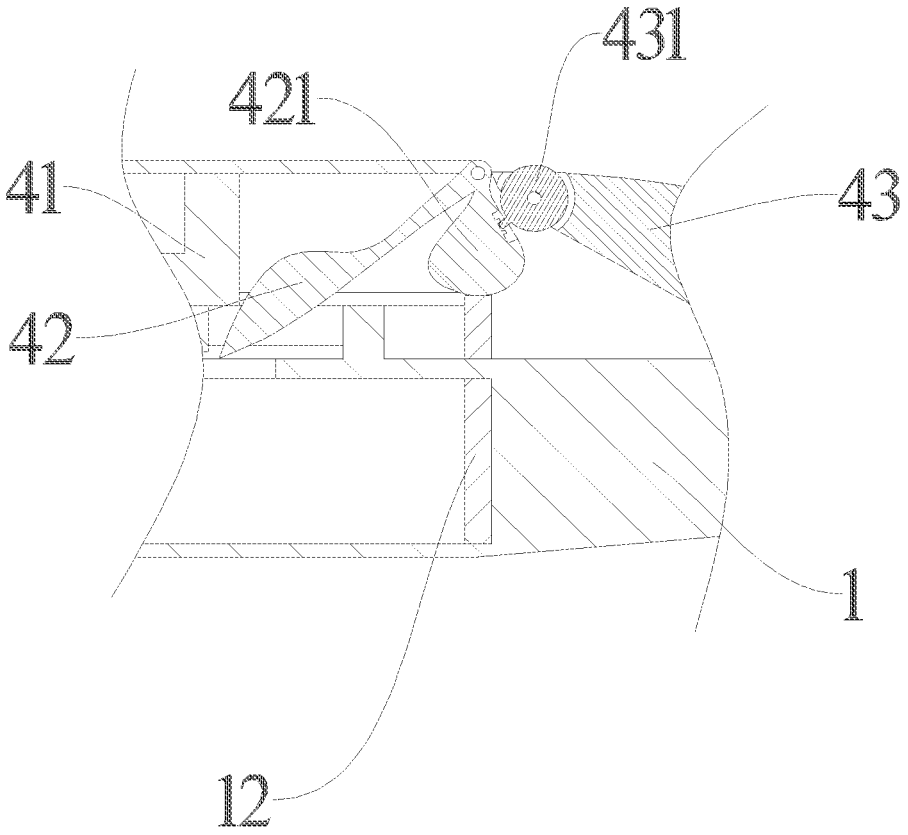
FIG. 10 is a cross-sectional view of another working state based on FIG. 9 according to the present invention, where at this time, an abutting member abuts against another clamping slot.
Figure 11:
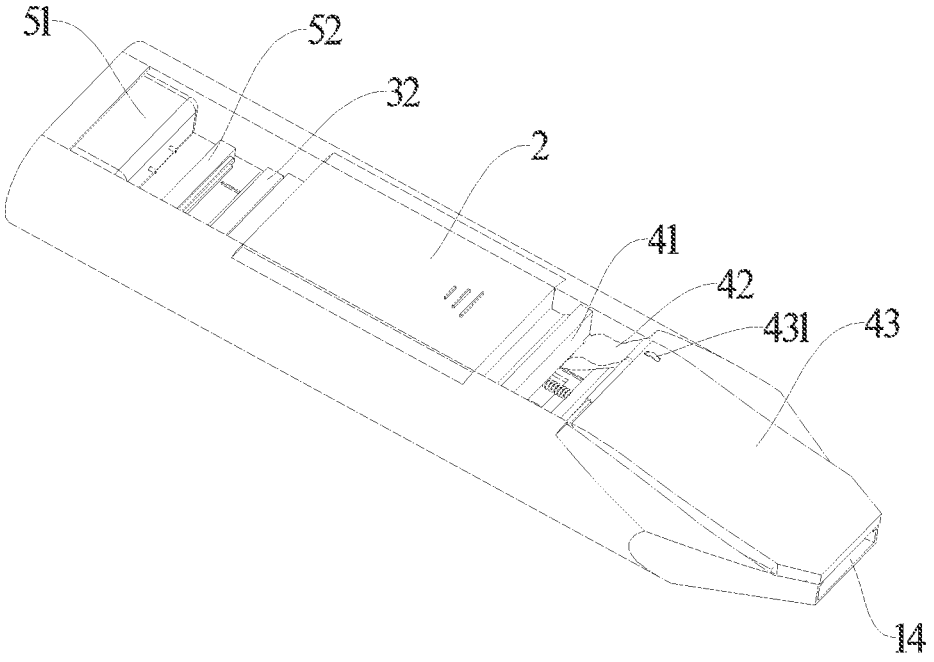
FIG. 11 is a schematic diagram of an internal structure of a leakage-proof electronic atomizer according to the present invention after an upper side of a shell is sectioned.

It can be understood that the abutting member 431 can abut against different clamping slots 421, so that supporting positions of the opening member 43 and the hinge block 42 are different, and therefore, the opening member 43 has different opening angles. Specifically, referring to FIG. 9 and FIG. 10, in this embodiment, when the abutting member 431 abuts against the clamping slot 421 closest to a rotation axis, the opening angle between the opening member 43 and the hinge block 42 is the largest. Therefore, a closer distance from the clamping slot 421 supported by the abutting member 431 to the rotation axis of the hinge block 42 results in a larger opening angle between the opening member 43 and the hinge block 42 and a longer stroke that the opening member 43 can pass through when abutting against the shell 1, thereby driving the hinge block 42 to rotate by a larger angle, which enables the first orifice plate 24 to move a longer distance to the left, thereby reducing a distance required to move by the second orifice plate 3 for completely aligning the first square holes 241 and the second square holes 33.

Figure 7:
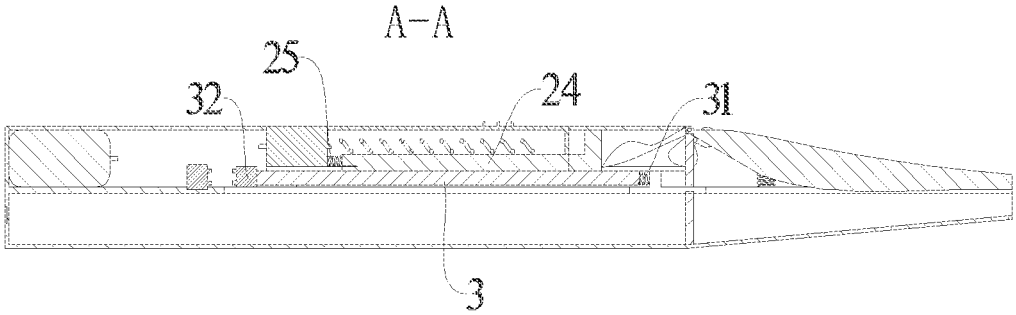
FIG. 7 is a cross-sectional view of another working state based on FIG. 4 according to the present invention, where at this time, an opening member abuts against a shell, and a first orifice plate is moved to the left.

Preferably, referring to FIG. 4 and FIG. 7, when the hinge block 42 is rotated without being abutted by the opening member 43, one end of the hinge block 42 close to the first orifice plate 24 is located on a moving path of the second orifice plate 3 so as to limit the sliding of the second orifice plate 3, and after the hinge block 42 is rotated in the forward direction, the hinge block 42 is allowed to leave the moving path of the second orifice plate 3, thereby enabling the second orifice plate 3 to slide freely.

Preferably, the gas channel 11 is provided with a filter plate 12. It can be understood that by arranging the filter plate 12, large particle droplets can be filtered, thereby improving the comfort of the smoker.

Preferably, the shell 1 is provided with sinking grooves 17 on two sides of the cartridge 2, and a top surface of the cartridge 2 is higher than the bottoms of the sinking grooves 17 to facilitate replacing the cartridge 2.

Preferably, baffles 432 are respectively provided on two sides of the opening member 43, the shell 1 is provided with escape grooves 18 corresponding to the baffles 432, and the baffles 432 extend into the escape grooves 18. It can be understood that by providing the escape grooves 18 and the baffles 432, the smoke can be prevented from overflowing from two sides of the opening member 43.

Preferably, a first magnetic attraction member 22 is provided on a lower side of the cartridge body 21, and the accommodation cavity 15 is provided with a second magnetic attraction member (not shown). When the cartridge body 21 is arranged in the accommodation cavity 15, the first magnetic attraction member 22 and the second magnetic attraction member are attracted to each other.

Figure 5:
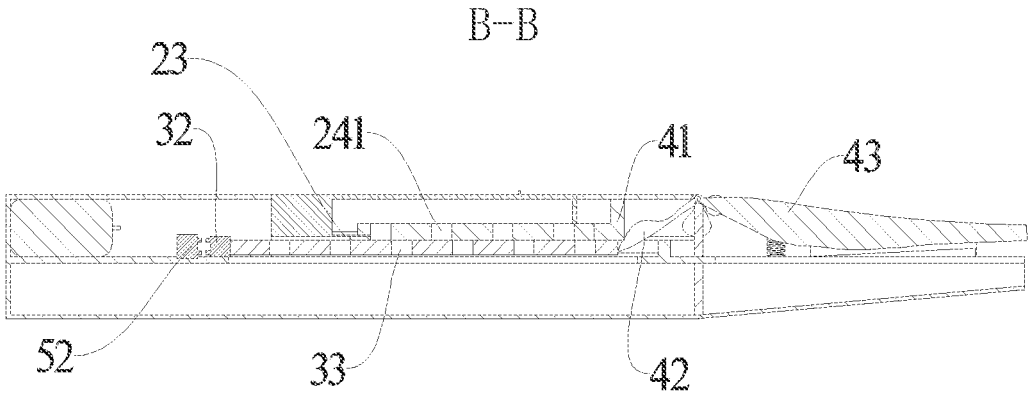
FIG. 5 is a cross-sectional view based on a B-B plane of FIG. 3 according to the present invention.
Figure 6:
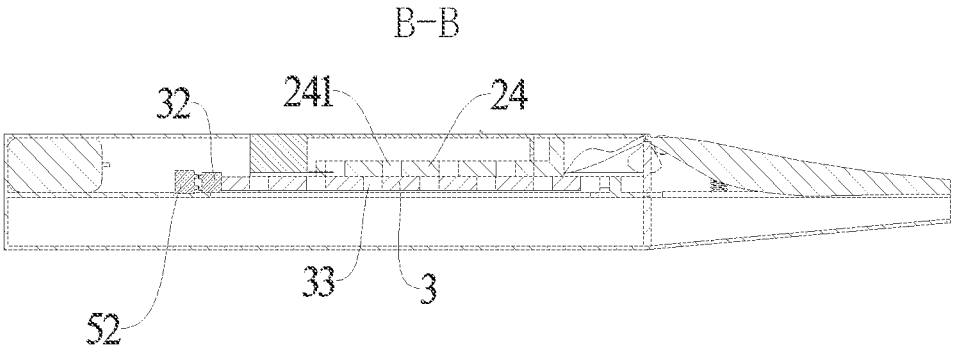
FIG. 6 is a cross-sectional view of another working state based on FIG. 5 according to the present invention, where at this time, an opening member abuts against a shell, and a first orifice plate is moved to the left.

A working method of the present invention is as follows. Referring to FIG. 3 to FIG. 5, when smoking, a smoker bites an upper side of the opening member 43 and a lower side of the shell 1 by using his/her lips or teeth, and forcefully clamps so that the opening member 43 is rotated to drive the hinge block 42 to rotate, thereby pushing the first orifice plate 24 to move to the left, as shown in FIG. 6. At this time, the first square holes 241 and the second square holes 33 are still not in communication.

Figure 8:
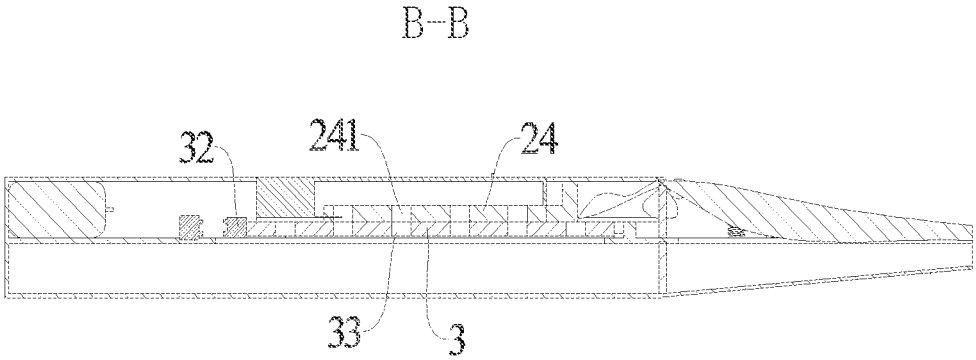
FIG. 8 is a cross-sectional view of still another working state based on FIG. 5 according to the present invention, where at this time, an opening member abuts against a shell, a first orifice plate is moved to the left and is in a sucking state, and a second orifice plate is moved to the right so that first square holes overlap second square holes.

Then, the smoker inhales, so that air enters the gas channel 11 from the gas inlet 13 and the microphone 53 detects the sound, which causes a current to be generated in the circuit. A louder sound results in a larger current. The electromagnet 52 generates magnetism to repel the magnetic member 32, so that the magnetic member 32 moves away from the electromagnet 52, thereby driving the second orifice plate 3 to slide to the right, so that the second square holes 33 are in communication with the first square holes 241, as shown in FIG. 8. As the inhalation force increases, openings communicating the second square holes 33 and the first square holes 241 are increased, and the current is increased, which increases the smoke output of the cartridge 2.

After the e-liquid in the cartridge 2 is exhausted, the cartridge 2 may be disassembled and replaced.

It is worth mentioning that, as shown in FIG. 5 and FIG. 6, the cartridge body 21 is provided with a partition 23, and the partition 23 can be inserted into the first orifice plate 24, so that when the first orifice plate 24 slides, a left end of the first orifice plate 24 and the cartridge body are always in a closed state.

The technical features of the above embodiments may be combined arbitrarily. In order to make the description concise, not all possible combinations of the various technical features in the above embodiments are described. However, as long as there is no contradiction in the combinations of these technical features, they all should be considered as the scope of this specification.

The above embodiments only express several implementations of the present invention, and their description is relatively specific and detailed, but they should not be understood as a limitation on the scope of the invention patent. It should be pointed out that for those of ordinary skill in the art, without departing from the concept of the present invention, several modifications and improvements may be made, and these modifications and improvements all fall within the protection scope of the present invention. Therefore, the protection scope of the patent of the present invention should be subject to the appended claims.

What is claimed is:

1. A leakage-proof electronic atomizer, comprising:

a shell provided with a gas channel, wherein the gas channel comprises a gas inlet at one end and a gas outlet at the other end, and a top of the shell is provided with an accommodation cavity with an upper-end opening;

a cartridge, detachably arranged in the accommodation cavity and comprising a cartridge body, an electric heating wire, a first orifice plate, and a first elastic member, wherein the electric heating wire is arranged in the cartridge body and is configured to heat e-liquid in the cartridge body to generate smoke, the first orifice plate is slidably arranged on the cartridge body, one end of the first elastic member abuts against the shell, and the other end of the first elastic member abuts against the first orifice plate;

a second orifice plate, slidably arranged in the shell, wherein the first orifice plate is attached to the second orifice plate, and by moving the first orifice plate and the second orifice plate, a through hole on the first orifice plate is allowed to be in communication with a through hole on the second orifice plate, so that the smoke generated by the cartridge is able to enter the gas channel; and a pushing component, comprising a sliding push block, a hinge block, and an opening member, wherein the opening member is rotatably arranged on the shell and is located on an upper side of the gas outlet, the hinge block is hinged on the shell and abuts against the opening member, the sliding push block is slidably arranged in the shell, and has one end abutting against one end of the first orifice plate away from the first elastic member and the other end abutting against the hinge block, and when the opening member rotates in a forward direction, the hinge block is configured to be driven to rotate in the forward direction, such that the sliding push block is pushed to slide in a direction toward the gas inlet, and the first orifice plate is further pushed to slide, wherein the second orifice plate is slidably arranged in the shell, a second elastic member is arranged between the second orifice plate and the shell, a magnetic member is arranged on one end of the second orifice plate away from the second elastic member, and the shell is further provided with a power supply, an electromagnet, a microphone, and a control unit, wherein the power supply, the electromagnet, the microphone, the control unit, and the electric heating wire are electrically connected; according to a magnitude of a wind sound received by the microphone, the control unit is configured to control a magnitude of a current in a circuit; and after the microphone detects the wind sound, the electromagnet generates a magnetic field to repel the magnetic member, thereby pushing the second orifice plate to slide away from the electromagnet to press the second elastic member; and the first orifice plate is provided with a plurality of first square holes, the second orifice plate is provided with a plurality of second square holes corresponding to the plurality of first square holes on the first orifice plate, when the first orifice plate moves in a direction towards the gas inlet, the plurality of second square holes are in communication with the plurality of first square holes, respectively, and as the first orifice plate gets closer to the gas inlet, an overlapping area of the second square holes and the first square holes is increased.

2. The leakage-proof electronic atomizer according to claim 1, wherein the opening member is rotatably provided with an abutting member, and the hinge block is provided with a plurality of clamping slots, and by rotating the abutting member, the abutting member is allowed to abut against different clamping slots of the plurality of clamping slots, such that different angles are formed between the opening member and the hinge block.

3. The leakage-proof electronic atomizer according to claim 2, wherein the shell is provided with a tension spring, and the tension spring is connected to the opening member so that the opening member abuts against the hinge block.

4. The leakage-proof electronic atomizer according to claim 1, wherein when the hinge block is rotated, one end of the hinge block adjacent to the first orifice plate is located on a moving path of the second orifice plate so as to limit sliding of the second orifice plate, and after the hinge block is rotated in the forward direction, the hinge block is allowed to leave the moving path of the second orifice plate, such that the second orifice plate is enabled to slide freely.

5. The leakage-proof electronic atomizer according to claim 1, wherein the gas channel is provided with a filter plate.

6. The leakage-proof electronic atomizer according to claim 1, wherein the shell is provided with sinking grooves on two sides of the cartridge, and a top surface of the cartridge is higher than the bottoms of the sinking grooves.

7. The leakage-proof electronic atomizer according to claim 1, wherein baffles are respectively provided on two sides of the opening member, the shell is provided with escape grooves corresponding to the baffles, and the baffles extend into the escape grooves.

8. The leakage-proof electronic atomizer according to claim 1, wherein a first magnetic attraction member is provided on a lower side of the cartridge body, and the accommodation cavity is provided with a second magnetic attraction member, and when the cartridge body is arranged in the accommodation cavity, the first magnetic attraction member and the second magnetic attraction member are attracted to each other.

* * * * *